US011859530B2

(12) United States Patent
Arndt et al.

(10) Patent No.: US 11,859,530 B2
(45) Date of Patent: Jan. 2, 2024

(54) EQUALIZING TANK FOR A COOLING CIRCUIT OF A MOTOR OF A MOTOR VEHICLE

(71) Applicant: Audi AG, Ingolstadt (DE)

(72) Inventors: Peter Arndt, Ingolstadt (DE); Jens Blüher, Schübelbach (CH); Jens Brand, Tann (CH); Martin Gehring, Tamm (DE); Denise Hollis, Malsch (DE)

(73) Assignee: Audi AG, Ingolstadt (DE)

( * ) Notice: Subject to any disclaimer, the term of this patent is extended or adjusted under 35 U.S.C. 154(b) by 0 days.

(21) Appl. No.: 17/868,560

(22) Filed: Jul. 19, 2022

(65) Prior Publication Data

US 2023/0024767 A1 Jan. 26, 2023

(30) Foreign Application Priority Data

Jul. 21, 2021 (DE) ..... 102021118799.0

(51) Int. Cl.
*F01P 11/02* (2006.01)

(52) U.S. Cl.
CPC ..... *F01P 11/029* (2013.01)

(58) Field of Classification Search
CPC . F01P 11/029; F01P 11/00; F01P 11/02; F01P 11/0204; F01P 11/028; F01P 11/0285
See application file for complete search history.

(56) References Cited

U.S. PATENT DOCUMENTS

| | | | | |
|---|---|---|---|---|
| 2010/0089913 | A1* | 4/2010 | Dexter | F01P 11/029 220/4.12 |
| 2017/0274758 | A1* | 9/2017 | Cho | F01P 11/029 |
| 2022/0074339 | A1* | 3/2022 | Won | F01P 11/029 |

FOREIGN PATENT DOCUMENTS

| | | | |
|---|---|---|---|
| CN | 104747268 | A | 7/2015 |
| DE | 4025067 | C1 | 7/1991 |
| DE | 102009042275 | A1 | 4/2010 |
| DE | 102017009431 | A1 | 5/2018 |
| DE | 102017119704 | A1 | 2/2019 |
| FR | 2890109 | A1 | 3/2007 |
| FR | 3055926 | A1 | 3/2018 |
| JP | 2008075598 | A | 4/2008 |

* cited by examiner

*Primary Examiner* — Jacob M Amick
(74) *Attorney, Agent, or Firm* — SEED INTELLECTUAL PROPERTY LAW GROUP LLP

(57) ABSTRACT

An equalizing tank for a cooling circuit of a motor of a motor vehicle has a tank top piece, on which an inlet line for a coolant is arranged, and a tank bottom piece, on which an outlet line for the coolant is arranged. The inlet line for the coolant is configured as a separate structural unit from the tank top piece, having an outlet opening situated in the region of the tank bottom piece.

9 Claims, 3 Drawing Sheets

EQUALIZING TANK FOR A COOLING CIRCUIT OF A MOTOR OF A MOTOR VEHICLE

BACKGROUND

Technical Field

Embodiments of the invention relate to an equalizing tank for a cooling circuit of a motor of a motor vehicle. Furthermore, embodiments of the invention relate to a cooling circuit having such an equalizing tank as well as a motor vehicle having such an equalizing tank.

Description of the Related Art

In general, such equalizing tanks are installed in cooling circuits particularly for two purposes, namely, on the one hand, in order to compensate for a heat or temperature-related expansion of the volume of the coolant circulating within the cooling circuits and, on the other hand, to promote a degassing especially of air inside the coolant, which may occur for example due to different flow rates at the inlet and outlet of the equalizing tank. In particular, air must be prevented from getting into the cooling circuit of the respective motor from the equalizing tank.

This problem arises very often in particular in electric vehicles and the corresponding electric motors, since for example a lower pressure may occur in the equalizing tank due to different flow rates in the area of the inlet line and the outlet line. Relatively low temperatures in the cooling circuit play a significant role here. To avoid such air inclusions in the cooling circuits of electric motors, deaeration valves are customarily used at present, but these are very costly and require additional electrical components for the control of the valves.

An equalizing tank for a cooling circuit of a motor of a motor vehicle is already known from FR 30 55 926 A1, being formed from a tank top piece, on which an inlet line for a coolant is arranged, and a tank bottom piece, on which an outlet line for the coolant is arranged.

Furthermore, such an equalizing tank is known from DE 10 2017 009 431 A1, comprising a tank top piece having an inlet line and a tank bottom piece having an outlet line. In order to have a variable configuration of the inlet line for different usage purposes and coolants, inserts are provided, by means of which for example the coolant can be diverted. This inlet line is substantially arranged outside the equalizing tank or the tank top piece.

Finally, an equalizing tank is likewise known CN 104 747 268 A, comprising an outside-applied multipiece inlet line and an outlet line.

BRIEF SUMMARY

Some embodiments include an equalizing tank of the kind mentioned above in which the entrainment of gas, especially air, in the cooling circuit or the corresponding coolant is prevented.

In some embodiments, an equalizing tank comprises a tank top piece, on which an inlet line for a coolant is arranged, and a tank bottom piece, on which an outlet line for the coolant is arranged. In order to avoid the danger of entraining gas, especially air, from the equalizing tank into the cooling circuit of the respective motor, the inlet line for the coolant is configured as a separate structural unit from the tank top piece, having an outlet opening situated in the region of the tank bottom piece. Thanks to the separate configuration of the inlet line from the tank top piece, it is consequently possible to very easily regulate the flow rate of coolant in the area of the inlet line and to adapt it by suitable dimensioning, in particular, to the passage of coolant in the area of the outlet line such that the flow rates may be adapted to each other. Thus, by separate configuring and adapting of the inlet line one prevents gas, especially air, from getting into the cooling circuit of the respective motor from the equalizing tank. The outlet opening of the inlet line for the coolant is situated in the region of the tank bottom piece, so that this is situated always below the minimum level of coolant inside the equalizing tank, in order to prevent in this way an additional entrainment of gas, especially air, in the coolant.

Thus, costly venting valves and their control system can be eliminated in particular from cooling circuits of electric motors for the propulsion of the respective motor vehicle.

The equalizing tanks described herein may be adapted to cooling circuits of different motors or different sizes and different cooling demands, without having to adapt the tank top piece in particular to the flow rates. Instead, in the equalizing tank described herein, a single tank top piece is enough to handle many makes and models, and a separate model-specific inlet line can be mounted on it according to the configuration of the equalizing tank or adapted to its dimensions. In this way, a corresponding building block system can be created in simple fashion, having a tank top piece suitable for different models and a model-specific structural unit, which forms the inlet line for the coolant and which is mounted on the tank top piece.

In this context, the coolant inlet line may be fixed on the inside of the tank top piece. In this way, the tank top piece or the inlet line can be adapted to the particular specifics of the corresponding cooling circuit.

An especially simple adaptation of the inlet line for the coolant can be realized when this is formed by a hose at least in one length region, being supported by a holder at least along one length region. Hence, the inlet line described herein is formed by the hose, which has an elastic resilient configuration, for example, and which can be adjusted in simple fashion in its cross section and its length to the flow rate of coolant. This hose may be supported by means of a holder, so that an optimal positioning inside the equalizing tank results; in particular, the outlet opening of the hose is always situated in the region of the tank bottom piece or below the minimum level of the coolant, in order to prevent an unwanted entrainment of gas, especially air.

In this context, the holder can be formed either as a separate structural unit from the tank top piece or as a structural unit integrated or forming a single piece with the tank top piece. The separate configuration of the holder enables in particular a corresponding building block system for adapting the equalizing tank to different concepts, while the single-piece configuration of the holder makes possible an especially simple design.

Another embodiment calls for the hose to be adapted in its length to a flow rate of coolant. Thus, merely by cutting the hose to an appropriate length, an adjusting of the flow rate or other parameters of the coolant or the cooling circuit is possible. The model-specific configuration can be achieved simply by cutting the hose to length.

The hose may be made of an elastically resilient material, which is supported by the corresponding holder. This produces an optimal run of the hose along the equalizing tank. Alternatively to this, however, a conduit other than a hose would also be conceivable.

The holder described herein is configured in its length independently of the flow rate of coolant and uniform in its configuration. Hence, the holder as well as the tank top piece may be suitable to several variant designs of the equalizing tank. In this way, in particular, the production and fabrication costs can be reduced.

Embodiments of the invention also encompass a cooling circuit for a motor of a motor vehicle having an equalizing tank as described herein, as well as a motor vehicle having such an equalizing tank.

Embodiments of the invention also encompass combinations of the features of the described embodiments, as long as the embodiments were not described as being mutually exclusive.

DETAILED DESCRIPTION

Figure 1:
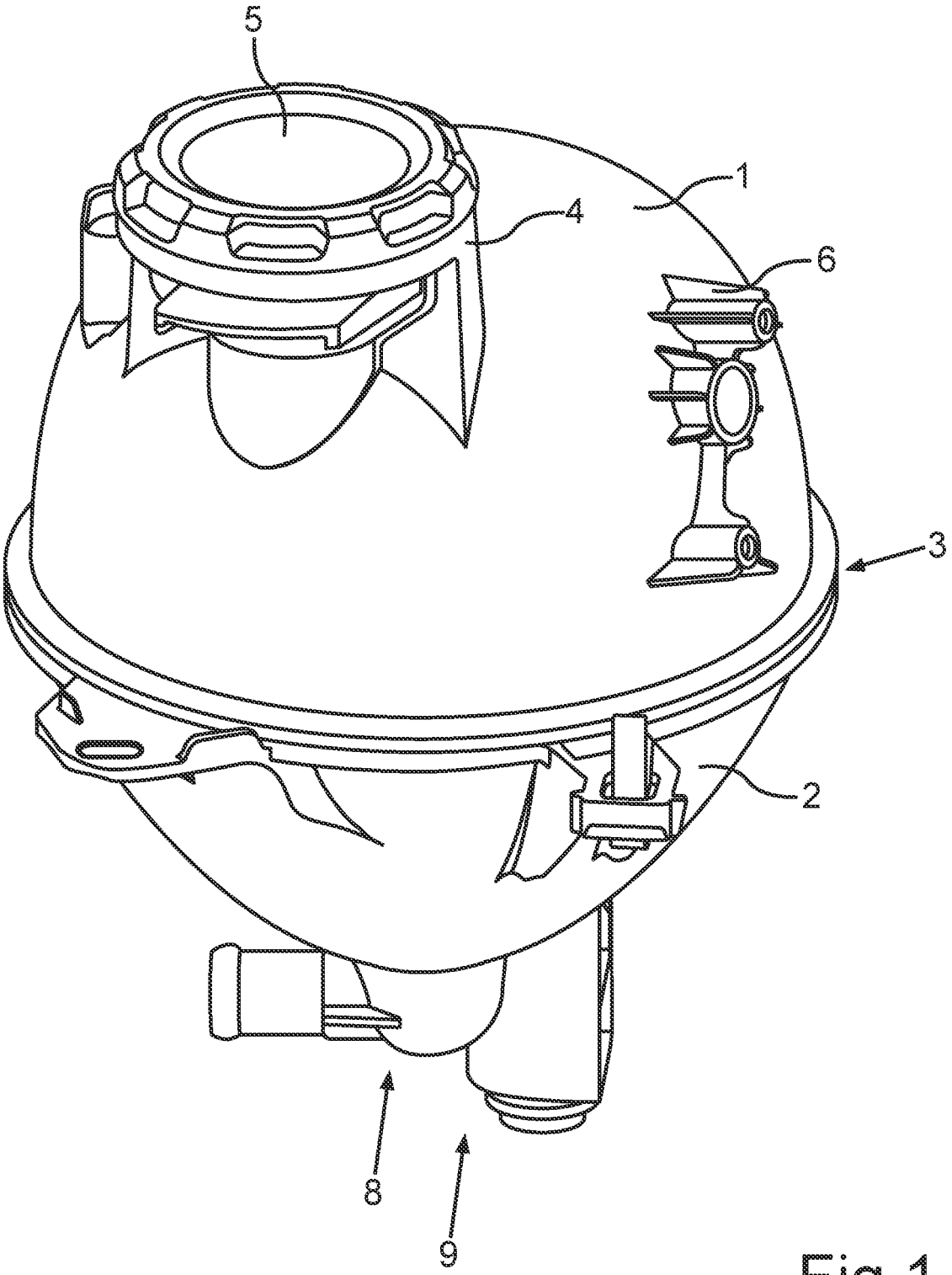
FIG. 1 shows a perspective front view of an equalizing tank for a cooling circuit of the electric motor of a motor vehicle having a tank top piece and a tank bottom piece.

FIG. 1 shows in a perspective front view an equalizing tank for a cooling circuit of a motor, in the present instance an electric motor, of a drive unit in the motor vehicle, such as an automobile. The equalizing tank in the present instance comprises a tank top piece 1 and a tank bottom piece 2, which are removably joined together in the region of an encircling and sealing flange connection 3. At the top of the housing top piece 1, there is provided a fill nozzle 4 for the filling of coolant, especially water provided with antifreeze, being closed by a lid 5.

Furthermore, there can be seen in FIG. 1 a connection fitting 6 of an inlet line 7, to be explained further below, for the coolant kept on hand in the equalizing tank and entering the equalizing tank from the cooling circuit tank. At this connection fitting 6, a line of the cooling circuit can be attached, for example, by means of a pipe clamp or in another way.

At the bottom of the tank bottom piece 2 there is a connection fitting 8 for an outlet line 9, by which the coolant taken up in the equalizing tank can go from here to the cooling circuit of the drive motor.

The equalizing tank serves in the present case for two goals in particular, namely, on the one hand, the equalizing of a temperature-dependent thermal expansion or change in volume of the coolant, and on the other hand the degassing of air which has been taken up in the coolant. In order to avoid air getting from the equalizing tank into the cooling circuit of the electric vehicle or its drive motor, it is particularly important for no lower pressure to arise inside the equalizing tank. This is a significant problem, especially at low temperatures in the cooling circuit.

Figure 2C:
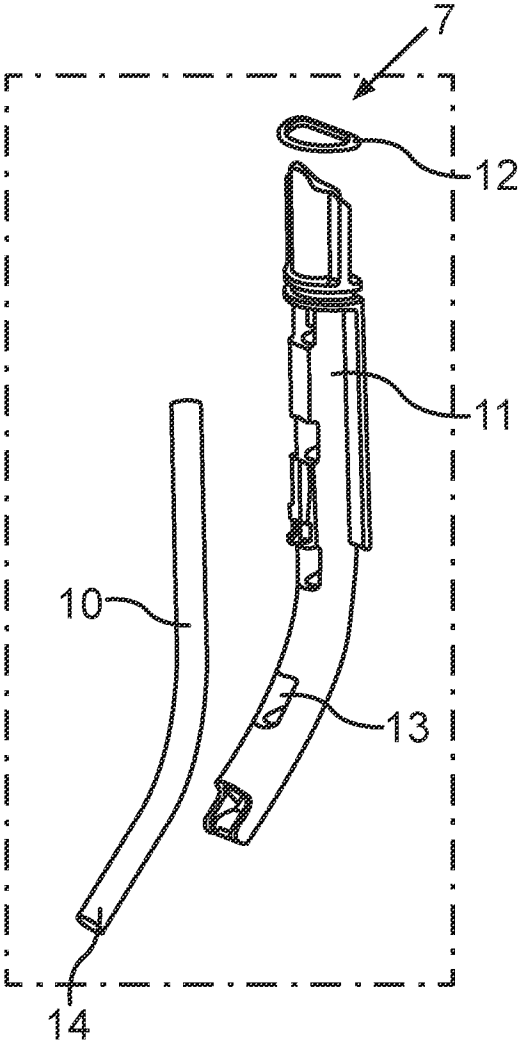
FIG. 2*c* shows a perspective exploded view of the components of the inlet line.
Figure 2B:
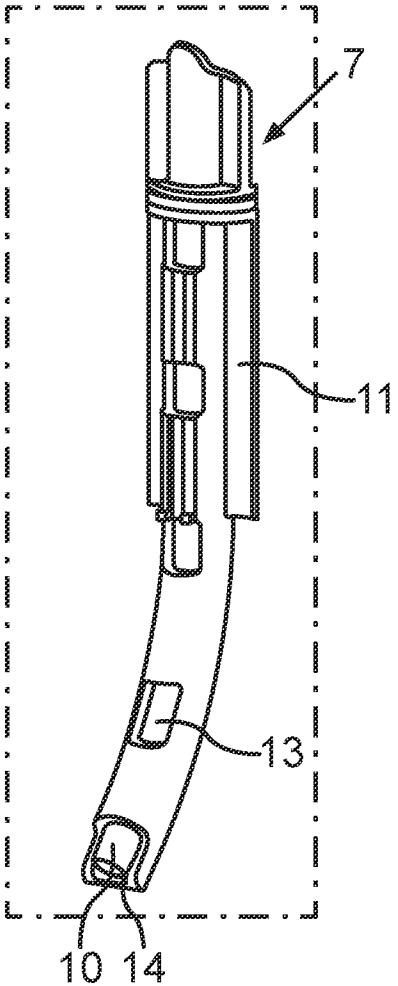
FIG. 2*b* shows a perspective front view of the separately configured inlet line.
Figure 2A:
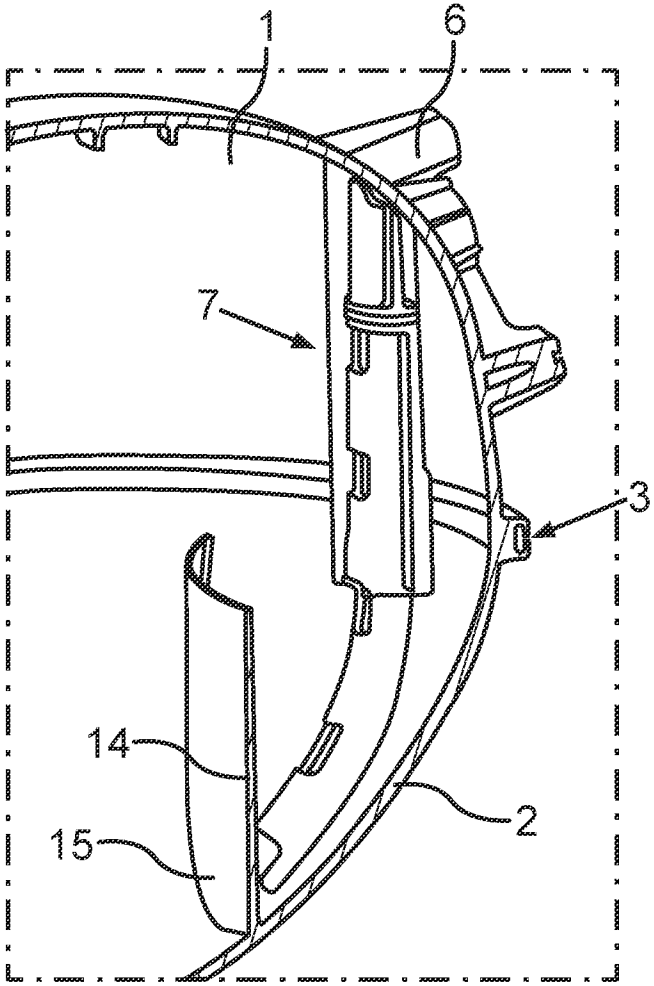
FIG. 2*a* shows a perspective cross sectional view of the equalizing tank according to a first embodiment having an inlet line for the coolant situated therein.

For this reason, in the present instance, as is moreover evident from a joint consideration of FIGS. 2*a*, 2*b* and 2*c*, the inlet line 7 is provided separately from the tank top piece 1 on the inside. FIG. 2*a* shows as a cutout view and in a cross sectional perspective front view the inlet line 7 mounted on the part 1 situated inside the equalizing tank, the inlet line 7 being further shown in FIG. 2*b* separately without equalizing tank and in an exploded perspective representation in 2*c*.

It is especially evident from FIG. 2*c* that the inlet line in the present case is formed by a hose which for example is made of an elastically resilient plastic material. This hose 10 is received at least for one length region in a tubular or snorkel shaped holder 11, which in turn is likewise configured separate from the equalizing tank, especially the tank top piece 1, and is mounted thereon across an O-ring 12. The hose 10 is connected fluid-tight to the connection fitting 6, so that coolant introduced via the connection fitting 6 from the cooling circuit to the equalizing tank goes by way of the hose 10 to the interior of the equalizing tank. The holder 11 here is adapted to the trend of the inside of the equalizing tank and provided with corresponding recesses 13.

As is especially evident from FIG. 2*a*, the hose 10 and the holder 11 are connected to the tank top piece 1, for example by suitable sliding connections, plug connections, or other kinds of connections, also for example with the aid of mechanical connection means such as detent elements, screws or the like. The hose 10 ends with an outlet opening 14 located in the area of the tank bottom piece 2 near a bottom end of the equalizing tank and near a surge wall 15, preventing a direct overflow of the coolant 9.

One peculiarity of the present equalizing tank is now to be seen in that the inlet line 7, especially its hose 10, as well as the holder 11, is configured as a separate structural unit from the tank top piece 1 and thus is or can be adapted individually to the respective circumstances of the cooling circuit for the drive motor. Thus, for example, and in particular, the length of the hose 10 can be varied, so as to control the flow rate of coolant in this way or adapt it to the flow rate going from the outlet line 9 to the cooling circuit. By an appropriate formation of the hose 10 in particular, a lower pressure in the equalizing tank can be prevented, so that air does not go from the equalizing tank to the cooling circuit. This has the advantage, in particular, that the tank top piece 1 can be used for multiple variant designs of cooling circuits or drive motors, only the particular inlet line 7, in the present instance the hose 10 in particular, needing to be adapted to the specific conditions of the cooling circuit and the coolant. Hence, a respective hose 10 or a respective inlet line 7 can be arranged, specific to a variant design, on the tank top piece which is suitable for variant designs.

In the present case, it is provided in particular that the holder 11 remains identical for some of the variant designs and in particular it has an identical length. Hence, in the present case, only the easily deflected hose 10 may need to be adjusted to the particular cooling circuit.

Figures 3A, 3B, 3C:
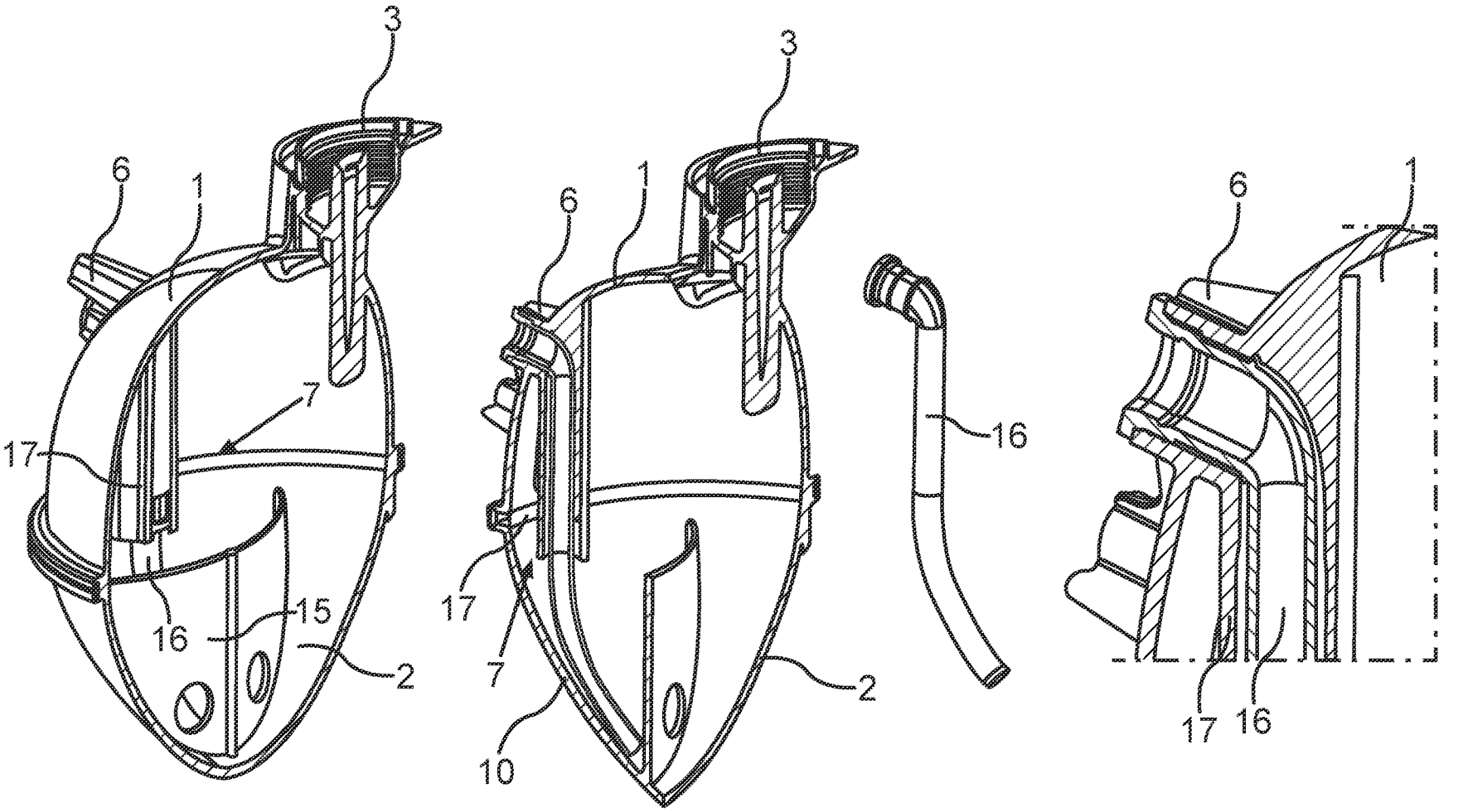
FIG. 3*a* shows a perspective cross sectional view of an equalizing tank.
FIG. 3*b* shows a perspective and cross sectional exploded view of the equalizing tank of FIG. 3*a*.
FIG. 3*c* shows an enlarged cross sectional perspective front view of the equalizing tank of FIG. 3*a*.

Another embodiment of the equalizing tank is shown in FIGS. 3*a* and 3*b* in a cross sectional perspective front view and a perspective exploded representation, respectively; in the following, only the differences between the two embodiments shall be discussed, and otherwise the structural parts should have at least substantially the same configuration. The embodiment according to FIGS. 3*a* and 3*b* is distinguished in particular by the alternative design of the hose 16, which in this case forms the inlet line 7. In the present instance, the holder 17 is configured as a substantially duct-shaped or tubular front piece, being formed as a single piece with the tank top piece 1 of the equalizing tank. By contrast with the embodiment of FIGS. 2*a* to 2*c*, therefore, no separate holder 11 is provided, but rather a holder 17 formed as a single piece with the tank top piece 1, extending just as far as the region of the tank bottom piece.

As can be seen from FIG. 3*b*, the hose 16 is inserted into the holder 17, passing to the outside through a wall of the tank top piece 1 and forming in this region the fitting 6 for the cooling circuit or being connected to the connection fitting 6. Furthermore, it can be seen from FIGS. 3*a* and 3*b* that the hose 16 extends to near the surge wall 15 in the area of the tank bottom piece 2, and—as in the case of the embodiment of FIGS. 2*a* to 2*c*— to near the lower end of the tank bottom piece 2 or that of the equalizing tank.

FIG. 3*c* shows in a cutout view and a cross sectional perspective front view the hose 16, once again in the area of the connection fitting 6, at which the equalizing tank is connected to the cooling circuit or a line of this cooling circuit. Also in the present case, the hose 16 is made from an elastically resilient plastic material. The tank top piece and the tank bottom piece 1, 2 are also formed primarily from corresponding plastic materials, as are the holders 11 and 17. Thus, also in the present instance, the hose 17 is configured as a separate structural unit from the tank top piece 1 and is held on it at the inside.

German patent application no. 10 2021 118799.0, filed Jul. 21, 2021, to which this application claims priority, is hereby incorporated herein by reference, in its entirety. Aspects of the various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. An equalizing tank for a cooling circuit of a motor of a motor vehicle, comprising:

a tank top piece, on which an inlet line for a coolant is arranged, and a tank bottom piece, on which an outlet line for the coolant is arranged, wherein the inlet line for the coolant is configured as a separate structural unit from the tank top piece, having an outlet opening situated within a region of the tank bottom piece;

wherein the inlet line for the coolant is formed by a hose, at least in one length region, being supported by a holder at least in one length region.

2. The equalizing tank according to claim 1, wherein the inlet line for the coolant is affixed to the inside of the tank top piece.

3. The equalizing tank according to claim 1, wherein the holder is configured separate from the tank top piece.

4. The equalizing tank according to claim 1, wherein the holder is configured as a single piece with the tank top piece.

5. The equalizing tank according to claim 1, wherein the hose is adapted in its length to a flow rate of coolant.

6. The equalizing tank according to claim 1, wherein the hose is made from an elastically resilient material.

7. The equalizing tank according to claim 1, wherein the holder is configured in its length independently of the flow rate of coolant.

8. A cooling circuit for a motor of a motor vehicle having an equalizing tank comprising:

a tank top piece, on which an inlet line for a coolant is arranged, and a tank bottom piece, on which an outlet line for the coolant is arranged, wherein the inlet line for the coolant is configured as a separate structural unit from the tank top piece, having an outlet opening situated within a region of the tank bottom piece;

wherein the inlet line for the coolant is formed by a hose, at least in one length region, being supported by a holder at least in one length region.

9. A motor vehicle having an equalizing tank for a cooling circuit of a motor of the motor vehicle, the equalizing tank comprising:

a tank top piece, on which an inlet line for a coolant is arranged, and a tank bottom piece, on which an outlet line for the coolant is arranged, wherein the inlet line for the coolant is configured as a separate structural unit from the tank top piece, having an outlet opening situated within a region of the tank bottom piece;

wherein the inlet line for the coolant is formed by a hose, at least in one length region, being supported by a holder at least in one length region.

* * * * *